US010018398B2

(12) United States Patent
Min et al.

(10) Patent No.: US 10,018,398 B2
(45) Date of Patent: Jul. 10, 2018

(54) REFRIGERATOR HAVING AIR PRESSURE CONTROLLABLE STORAGE CONTAINER AND STORAGE METHOD THEREOF

(71) Applicant: LG Electronics Inc., Seoul (KR)

(72) Inventors: Deulre Min, Seoul (KR); Ahreum Park, Seoul (KR); Kyongbae Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1330 days.

(21) Appl. No.: 13/911,614

(22) Filed: Jun. 6, 2013

(65) Prior Publication Data

US 2013/0327411 A1 Dec. 12, 2013

(30) Foreign Application Priority Data

Jun. 11, 2012 (KR) ..... 10-2012-0062288

(51) Int. Cl.
*F25B 19/00* (2006.01)
*F25D 17/04* (2006.01)
*F25D 25/00* (2006.01)

(52) U.S. Cl.
CPC ..... *F25D 17/042* (2013.01); *F25D 25/00* (2013.01); *F25D 2317/043* (2013.01); *Y10T 137/0396* (2015.04); *Y10T 137/86083* (2015.04)

(58) Field of Classification Search
CPC .. F25D 17/042; F25D 25/00; F25D 2317/043; F25D 2400/361; Y10T 137/0396; Y10T 137/86083
USPC ..... 62/169, 78; 137/14, 565.23
See application file for complete search history.

(56) References Cited

U.S. PATENT DOCUMENTS 4,006,260 A * 2/1977 Webb ..... A23B 7/02 426/438
4,829,774 A * 5/1989 Wassibauer ..... A23L 3/3418 62/78
5,946,919 A * 9/1999 McKinney ..... A21C 15/00 62/169
6,090,422 A * 7/2000 Taragan ..... A23L 3/0155 426/231
6,148,875 A * 11/2000 Breen ..... B65B 25/046 141/192
7,789,112 B1 * 9/2010 Wise ..... B60S 5/046 141/1

(Continued)

FOREIGN PATENT DOCUMENTS

CA 970509 A * 7/1975
CN 101948029 A 1/2011

(Continued)

OTHER PUBLICATIONS

Google translation of CN 102116553A.*

*Primary Examiner* — Elizabeth Martin
(74) *Attorney, Agent, or Firm* — Dentons US LLP

(57) ABSTRACT

A refrigerator having an air pressure controllable storage container is allowed to control air pressure of the storage container to be temporarily lower than initial air pressure by turning on and off a vacuum pump. The vacuum pump sucks internal air of the storage container, and a controller turns on the vacuum pump such that internal air pressure of the storage container is lower than the initial air pressure, and turns off the vacuum pump such that the internal air pressure is restored to the initial air pressure.

16 Claims, 9 Drawing Sheets

(56) References Cited

U.S. PATENT DOCUMENTS 8,528,346 B2 * 9/2013 Allard ..... A23L 3/3418 62/100
2002/0182878 A1 * 12/2002 Hirose ..... H01J 37/32449 438/710
2004/0213879 A1 * 10/2004 Jang ..... B65B 31/02 426/404
2006/0010890 A1 * 1/2006 Feinauer ..... F25D 17/042 62/169
2007/0234754 A1 * 10/2007 Pimputkar ..... F25D 17/042 62/441
2008/0006041 A1 * 1/2008 Nakata ..... F25D 17/042 62/131
2008/0135126 A1 * 6/2008 Lemme ..... B65B 31/047 141/8
2008/0302114 A1 * 12/2008 Kelly ..... F25D 17/042 62/170
2009/0194193 A1 * 8/2009 Vonderhaar ..... F25D 17/042 141/65
2009/0211202 A1 * 8/2009 Lemme ..... F25D 17/042 53/432
2009/0272279 A1 * 11/2009 Kieck ..... A47J 47/10 99/468
2010/0101432 A1 * 4/2010 Biotti ..... A23L 3/3418 99/473
2010/0154651 A1 * 6/2010 Skalski ..... A47J 31/0668 99/302 R
2011/0147198 A1 * 6/2011 Okada ..... F04B 37/08 204/192.1
2012/0023971 A1 * 2/2012 Min ..... F25D 29/00 62/62
2014/0284239 A1 * 9/2014 Espinosa ..... B65D 81/00 206/459.5

FOREIGN PATENT DOCUMENTS

CN 101995142 A 3/2011
CN 102116553 A * 7/2011 ..... F25D 11/02
JP 2009008292 A * 1/2009 ..... F25D 11/02
JP 2009036457 A 2/2009
KR 20020043850 A * 6/2002
KR 10-2006-0041502 A 5/2006
KR 10-0943565 B1 2/2010
KR 1011462747 B1 5/2012

* cited by examiner

REFRIGERATOR HAVING AIR PRESSURE CONTROLLABLE STORAGE CONTAINER AND STORAGE METHOD THEREOF

CROSS-REFERENCE TO RELATED APPLICATION

This application claims priority to Korean Application No. 10-2012-0062288, filed in Korea on Jun. 11, 2012, the contents of which is incorporated by reference herein in its entirety.

BACKGROUND

1. Field of the Disclosure

This specification relates to a refrigerator having an air pressure controllable storage container, and particularly, to a refrigerator having an air pressure controllable storage container, capable of reducing dryness of vegetables stored so as to maintain optimal freshness of the vegetables by closing the storage container, preferably a hermetic storage container, and turning on a vacuum pump to control internal air pressure of the storage container to be temporarily lower than initial air pressure.

2. Background

In general, a refrigerator is equipment for keeping foods and the like in a cold state for an extended time by generating cold air in response to driving a refrigerating cycle installed inside the refrigerator and supplying the generated cold air into a refrigerating chamber and a freezing chamber.

The refrigerator is typically provided with a storage container that can be used for keeping and storing vegetables. Also, when vegetables are generally stored in the refrigerator, they should be kept in the freshest state. Therefore, it may be important to maintain the space for keeping vegetables in an optimal condition.

SUMMARY

As such, a refrigerator in a related art may include a chamber in its lower portion. The chamber may include the storage container for storing vegetables and fruits, and preferably, a cover that can hermetically close the storage container.

The cover may close the storage container to block an introduction of external air so as to maintain humidity in an inner space of the storage container. Preferably, the inside of the chamber is hermetically closed from the outside to maintain pressure which is different from external air pressure.

Accordingly, it may be preferable for internal air pressure of the storage container to be lower than external atmospheric pressure by hermetically closing the storage container. This may be allowed by turning on a vacuum pump to change the inside of the storage container into a low vacuum state such that the inside of the vegetable changer remains under pressure lower than the external atmospheric pressure.

As such, the inside of the storage container may be maintained at a predetermined air pressure (e.g., air pressure of 0.8 atm) by turning off the vacuum pump when the internal air pressure reaches the predetermined air pressure and turning on the vacuum pump when the internal air pressure no longer corresponds to the predetermined air pressure.

FIG. 1 shows the operating of the vacuum pump for maintaining air pressure within the inside of the storage container. As shown in FIG. 1, an apparatus for maintaining internal air pressure of the storage container may be configured to reduce internal air pressure of the storage container below about 0.8 atm by turning on a vacuum pump after the inside of the storage container is hermetically closed under an atmospheric pressure state. When the inside of the storage container is under the lowered air pressure state below 0.8 atm, the vacuum pump may be turned off.

Accordingly, the vacuum pump may be continuously controlled in order to maintain a predetermined internal air pressure of the storage container. This continuous driving of the vacuum pump may cause an increase in energy costs.

In addition, when the inside of the storage container is kept maintained under the predetermined air pressure, stuffs such as vegetables or fruits stored in the storage container may spoil according to their different varieties, and be dried due to transpiration of leaves of the vegetables and the like.

Therefore, an aspect of the detailed description is to provide a refrigerator having an air pressure controllable storage container, capable of enhancing freshness and preventing transpiration of stuffs such as vegetables, fruits and the like stored in the storage container.

Another aspect of the detailed description is to provide a refrigerator having an air pressure controllable storage container, capable of maintaining an appropriate air pressure state according to stuffs stored in the storage container in addition to an air pressure control condition, and simultaneously continuously controlling freshness of the stored stuffs by periodically reducing pressure in a manner of turning on a vacuum pump plural times.

Another aspect of the detailed description is to provide a refrigerator having an air pressure controllable storage container, capable of allowing for an input of an air pressure control mode in response to user selection and displaying the input air pressure control mode on a display unit, so as to allow the user's direct control of a state of the storage container and enhance user convenience.

Another aspect of the detailed description is to provide a refrigerator having an air pressure controllable storage container, capable of extending a lifespan of a vacuum pump by virtue of periodic activation of the vacuum pump, other than continuous activation, and enhancing economical efficiency by virtue of power reduction.

To achieve these and other advantages and in accordance with the purpose of this specification, as embodied and broadly described herein, a refrigerator has an air pressure controllable storage container, the refrigerator including a storage container configured to store stuff therein, a controller to control internal air pressure of the storage container, and a vacuum pump to suck internal air of the closed storage container. Here, the controller may turn on the vacuum pump such that internal air pressure of the storage container can be lower than initial air pressure and turn off the vacuum pump such that the internal air pressure can be restored to initial air pressure when an air pressure control mode is activated.

In accordance with another exemplary embodiment of the detailed description, the controller may control the vacuum pump such that a process of temporarily reducing internal air pressure of the storage container and restoring the internal air pressure to the initial air pressure can be repetitively carried out. Here, the controller may control the vacuum pump such that the temporarily pressure-reduced state lower than the initial air pressure can remain shorter than a state of being maintained at the initial air pressure.

The controller may control the internal air pressure of the storage container to be temporarily reduced two times based on 24 hours after hermetically closing the storage container. Or, the controller may control the internal air pressure of the storage container to be temporarily reduced four times based on 24 hours after hermetically closing the storage container. Or, the controller may control the internal air pressure of the storage container to be temporarily reduced six times based on 24 hours after hermetically closing the storage container.

In accordance with another exemplary embodiment of the detailed description, the controller may control the vacuum pump such that a process of temporarily reducing internal air pressure of the storage container and restoring the reduced air pressure to the initial air pressure is repetitively carried out. Here, the controller may control the vacuum pump such that the temporarily decompressed state lower than the initial air pressure remains shorter than a state of being maintained at the initial air pressure.

Also, the controller may adjust air pressure by temporarily reducing the internal air pressure of the storage container at 8-hour period. Or, the controller may adjust air pressure by temporarily reducing the internal air pressure of the storage container at 6-hour period. Or, the controller may adjust air pressure by temporarily reducing the internal air pressure of the storage container at 4-hour period.

In another aspect of the detailed description, the controller may allow a restoring time to the initial air pressure after the vacuum pump is turned on one time to be 7 minutes.

In another aspect of the detailed description, the controller may activate the air pressure control mode when the storage container is closed, and deactivate the air pressure control mode when the storage container is open.

In another aspect of the detailed description, the refrigerator may further include a display unit to display an air pressure state and/or the air pressure control mode of the storage container.

In another aspect of the detailed description, the refrigerator may further include an input unit to receive a selection of the air pressure control mode of the storage container.

In another aspect of the detailed description, the controller may control a temporarily reduced internal air pressure of the storage container to be maintained in the range of 0.95 to 1.0 atm when fruit is stored in the storage container.

In another aspect of the detailed description, the controller may control a temporarily reduced internal air pressure of the storage container to be maintained in the range of 0.8 to 0.9 atm when vegetable is stored in the storage container.

To achieve these and other advantages and in accordance with the purpose of this specification, as embodied and broadly described herein, a control method for a refrigerator with an air pressure controllable storage container, includes receiving a selection of an air pressure control mode of a refrigerator storage container, turning on a vacuum pump such that internal air pressure of the storage container is reduced below initial air pressure and turning off the vacuum pump such that the internal air pressure of the storage container is restored to the initial air pressure, when the air pressure control mode is selected.

In accordance with another exemplary embodiment, the method may further include setting an internal air pressure control condition of the storage container.

In accordance with another exemplary embodiment, the air pressure control condition may include at least one of a target air pressure to be reduced in response to the turn-on operation of the vacuum pump, the number of reducing air pressure, a reduced air pressure maintaining time, and an air pressure reduction period.

In accordance with another exemplary embodiment, the turning on of the vacuum pump and the turning off of the vacuum pump may be repetitively executed at a preset air pressure reduction period.

In accordance with another exemplary embodiment, the turning on of the vacuum pump and the turning off of the vacuum pump may be repetitively executed by a preset number of reducing air pressure.

In accordance with another exemplary embodiment, the turning off of the vacuum pump may include determining whether or not a preset reduced air pressure maintaining time and/or a preset target air pressure to be reduced has been reached in response to the turn-on operation of the vacuum pump, and turning off the vacuum pump when reached.

In accordance with another exemplary embodiment, the method may further include receiving a selection of a stuff to be stored in the storage container, and the air pressure control condition may be decided based on the selected stuff to be stored.

As described above, the present disclosure may acquire the following effects by the aforementioned technical solutions and configurations, coupling relationships and operation relationships to be explained later.

The present disclosure may prevent transpiration of stuffs such as vegetables and fruits stored in the storage container, and enhance freshness of the vegetables and fruits stored.

The present disclosure may maintain an appropriate air pressure state according to stuffs stored in the storage container as well as a reduced air pressure maintaining time and an air pressure control condition, and simultaneously control freshness of the stuffs stored in a continuous manner by a periodic air pressure control in response to plural-time turn-on operation of the vacuum pump.

The present disclosure may set an air pressure control mode according to user selection and display the user settings on a display unit, to allow the user to directly control freshness of the stuffs stored in the storage container and enhance the user's convenience.

The present disclosure may also extend a lifespan of the vacuum pump by properly turning on the vacuum pump in a periodic manner other than a continuous manner. This may allow for power reduction, resulting in enhancement of economical efficiency.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the invention.

In the drawings.

DETAILED DESCRIPTION OF THE PREFERRED EMBODIMENTS

Figure 1:
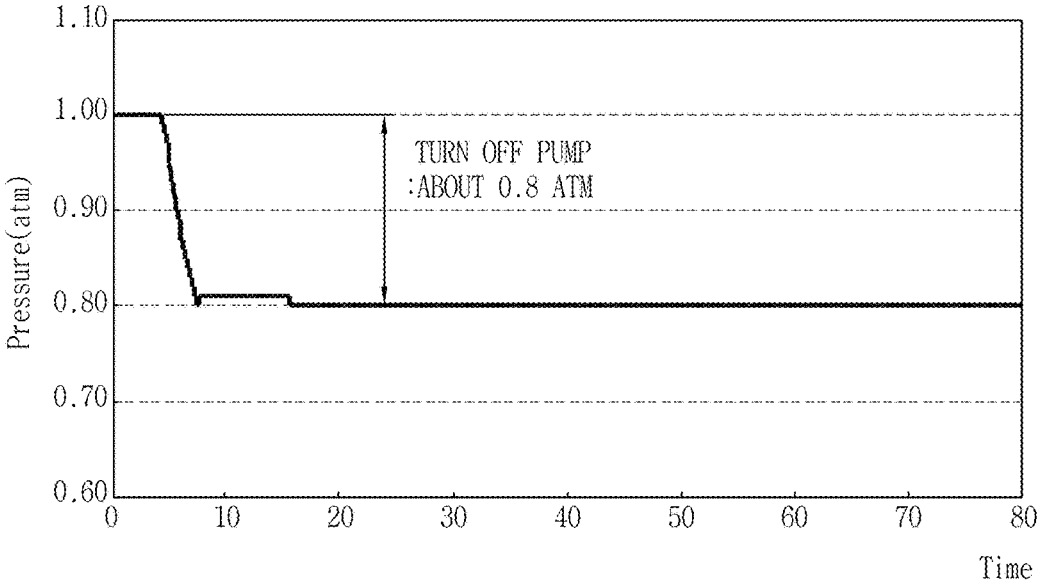
FIG. 1 RELATED ART
FIG. 1 is a graph showing internal air pressure of a storage container according to the related art.

Description will now be given in detail of a refrigerator having an atmospheric pressure controllable storage container and a control method thereof according to the exemplary embodiments, with reference to the accompanying drawings.

Terms or words used in this specification and the claims should not be construed as being limited to typical or dictionary definition, but be understood as meaning and conception that come within the technical scope of the present disclosure based on a principle that the inventor is able to appropriately define the conception of terms for describing his invention in the best way.

Therefore, the preferred embodiments described herein and configurations shown in the drawings are merely illustrative and should not be construed to limit the spirit of the invention. Therefore, it should be understood that there can be various equivalents and variations which can substitute the preferred embodiments at the time of filing this application.

Hereinafter, description will be given in detail of the exemplary embodiments according to the present disclosure with reference to FIGS. 2 to 9.

Figure 2:
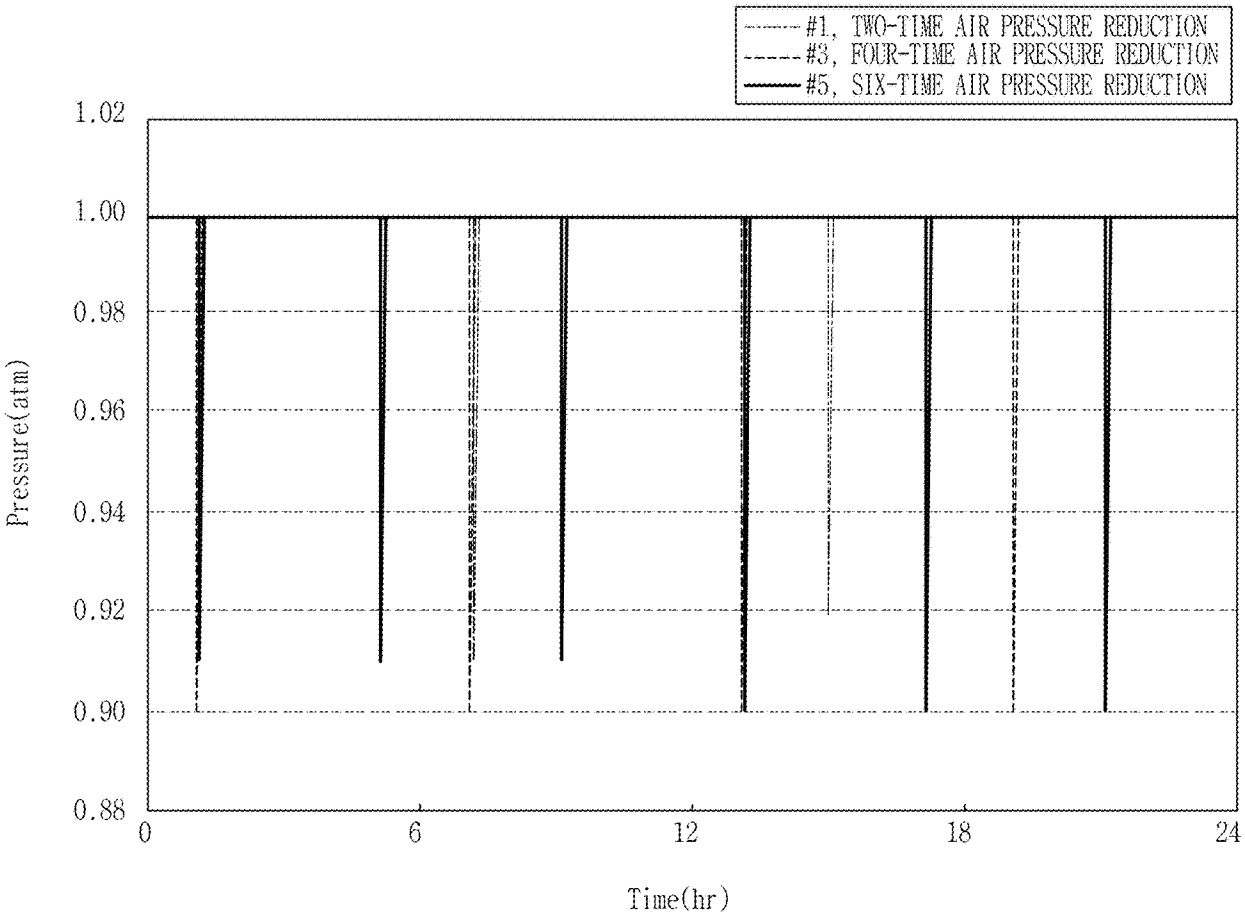
FIG. 2 is a graph showing internal air pressure of an air pressure controllable storage container in accordance with several exemplary embodiments of the present disclosure.
Figure 3:
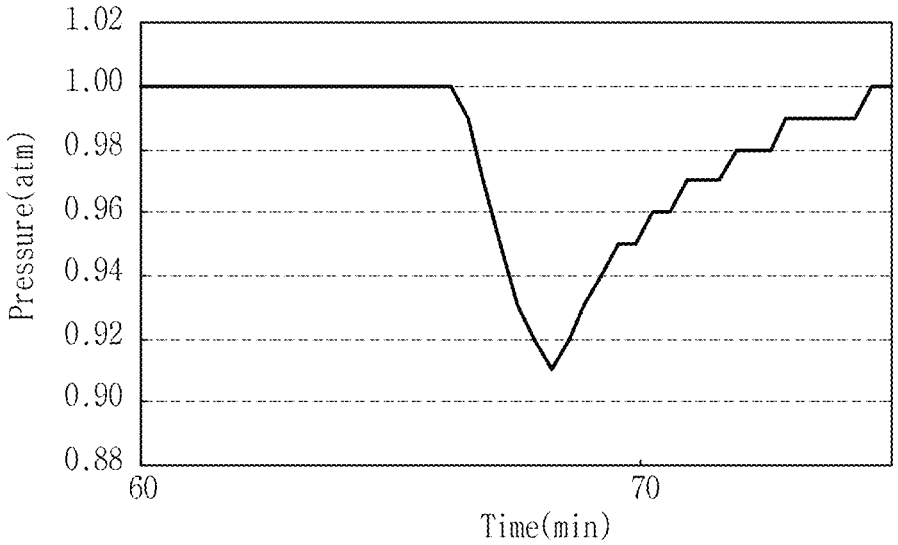
FIG. 3 is an enlarged view of a box portion indicated with a dotted line of FIG. 2.
Figure 4:
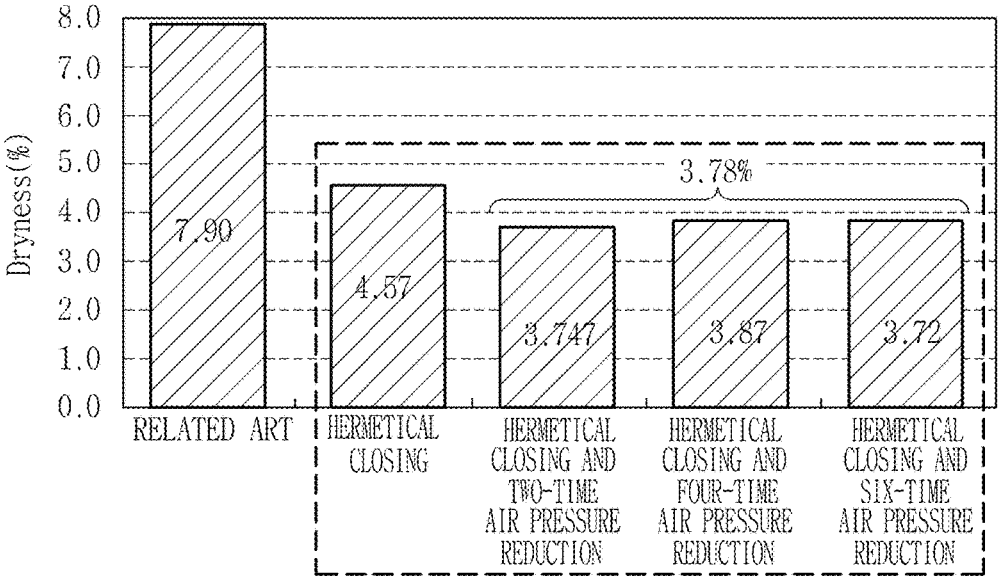
FIG. 4 is a graph showing internal dryness of the air pressure controllable storage container according to the exemplary embodiments shown in FIG. 2.
Figure 5:
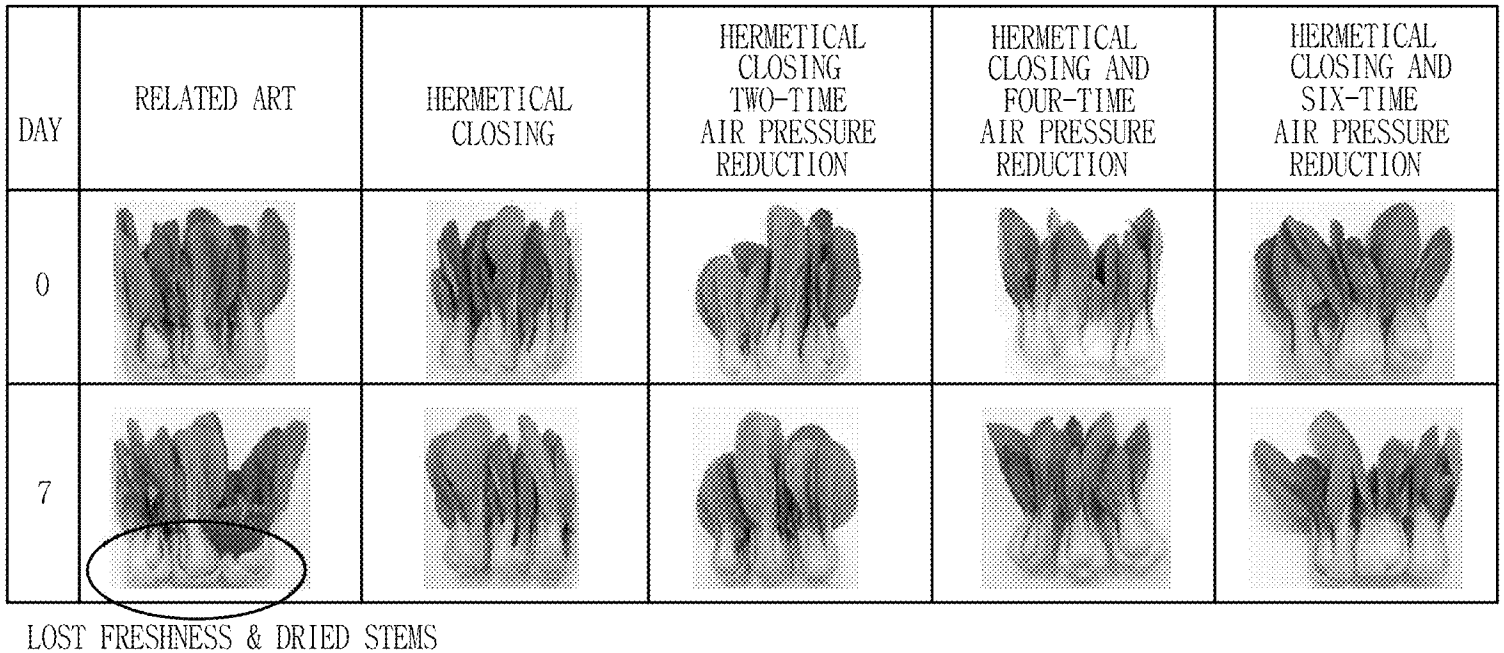
FIG. 5 shows photos of bok choy stored according to the related art and under pressure control according to the exemplary embodiments shown in FIG. 2, respectively.
Figure 6:
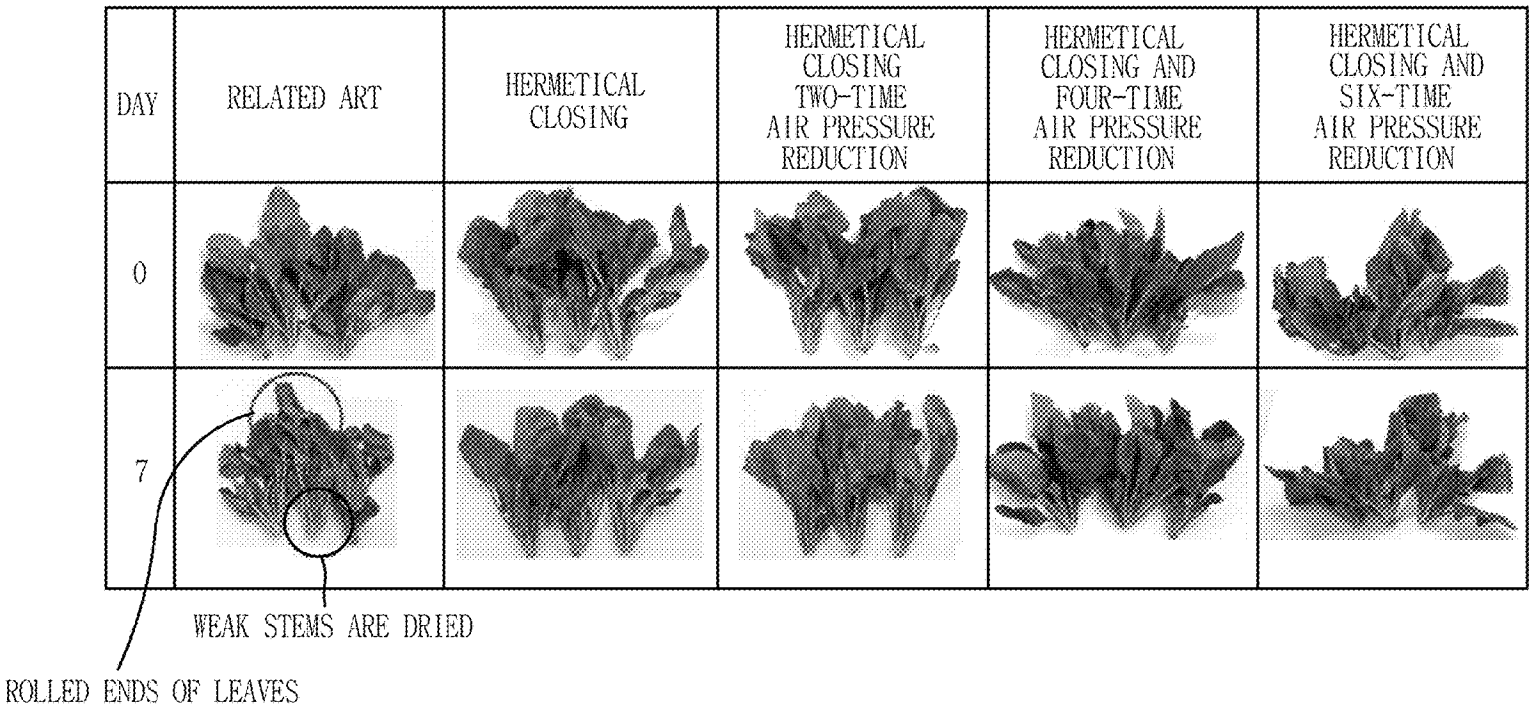
FIG. 6 shows photos of spinach stored according to the related art and under pressure control according to the exemplary embodiments shown in FIG. 2, respectively.
Figure 7:
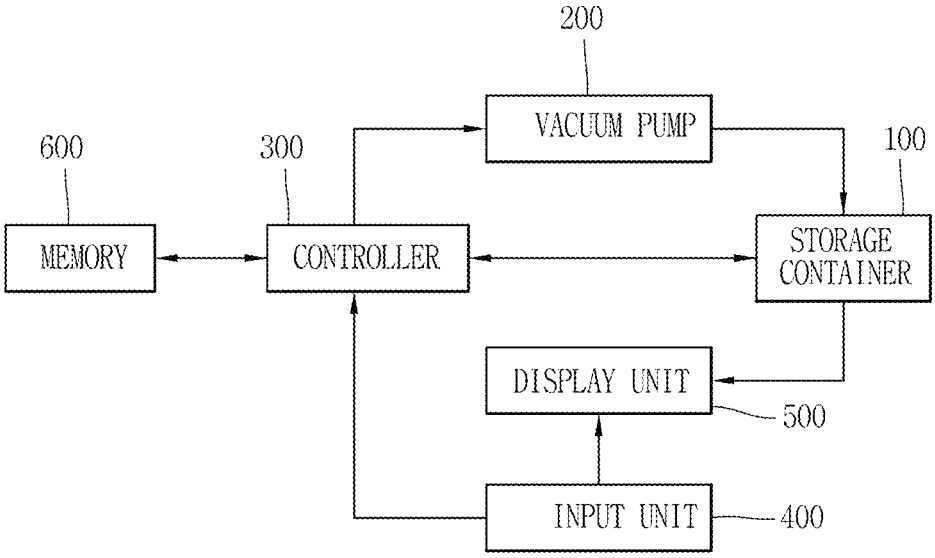
FIG. 7 is a block diagram schematically showing a control system associated with an air pressure controllable storage container in accordance with one exemplary embodiment of the present disclosure.
Figure 8:
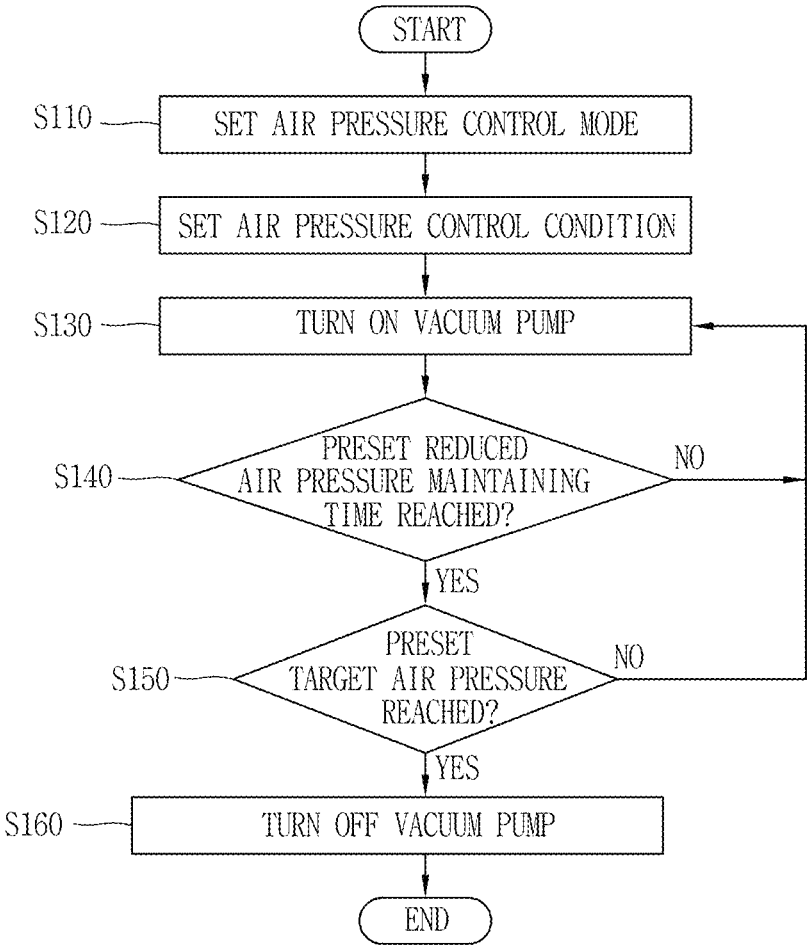
FIG. 8 is a flowchart showing a control method of an air pressure controllable storage container in accordance with one exemplary embodiment of the present disclosure.
Figure 9:
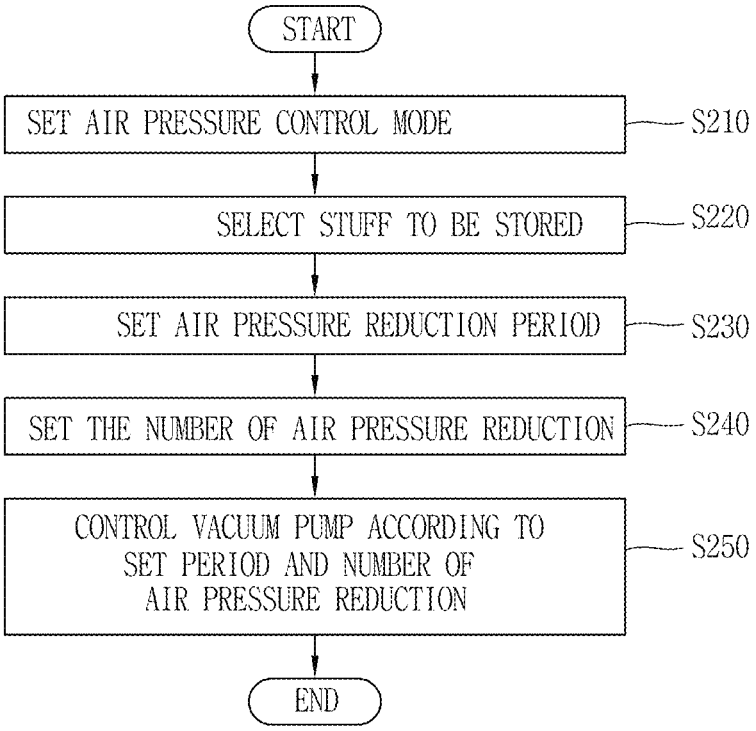
FIG. 9 is a flowchart showing a control method of an air pressure controllable storage container in accordance with another exemplary embodiment of the present disclosure.

FIG. 2 is a graph showing internal air pressure of an air pressure controllable storage container in accordance with several exemplary embodiments of the present disclosure, FIG. 3 is an enlarged view of a box portion indicated with a dotted line of FIG. 2, FIG. 4 is a graph showing internal dryness of the air pressure controllable storage container according to the exemplary embodiments shown in FIG. 2, FIGS. 5 and 6 show photos of bok choy and spinach stored according to the related art and under pressure control according to the exemplary embodiments shown in FIG. 2, respectively, FIG. 7 is a block diagram schematically showing a control system associated with an air pressure controllable storage container among components of a refrigerator having the air pressure controllable storage container in accordance with one exemplary embodiment of the present disclosure, FIG. 8 is a flowchart showing a control method in accordance with one exemplary embodiment of the present disclosure, and FIG. 9 is a flowchart showing a control method in accordance with another exemplary embodiment of the present disclosure.

First, as shown in FIGS. 2 and 3, in a refrigerator having an air pressure controllable storage container according to one exemplary embodiment, internal air pressure of a closed storage container may be controlled by a controller to be temporarily lower than initial air pressure. Preferably, the storage container is hermetically closed. The inside of the storage container of the refrigerator may be maintained at about 1 atm which is ambient air pressure for most of duration. The internal air pressure of the storage container may be temporarily reduced below air pressure of 1 atm as the controller turns on a vacuum pump. The internal air pressure of the storage container which has been temporarily reduced below 1 atm may be restored to its initial air pressure after about 7 minutes. That is, the controller may allow the inside of the storage container to be maintained in an air pressure-reduced state for about 7 minutes.

Here, the controller may repetitively execute a process of turning on and off the vacuum pump plural times with time intervals such that the internal air pressure of the storage container can be remarkably reduced lower than a predetermined air pressure (about 1.00 atm), and after approximately 7 minutes, allow the internal air pressure to revert to the level of the initial internal air pressure (see FIG. 2).

With the vacuum pump being repetitively turned on, the internal air pressure of the storage container of the refrigerator may be reduced. This may prevent transpiration of vegetables, fruits and the like stored in the storage container and reduce dryness, resulting in keeping such vegetables and fruits in a fresh state for an extended time.

Referring to FIG. 2 and FIG. 7, the refrigerator having the air pressure controllable storage container in accordance with the one exemplary embodiment may include a storage container 100 that hermetically keeps vegetables or fruits therein, a controller 300, for example, a microprocessor, that controls internal air pressure of the storage container 100, and a vacuum pump 200 that sucks internal air of the hermetically closed storage container 100. The controller 300 and the vacuum pump 200 are well known hardware to those skilled in the art and will not be further discussed.

When an air pressure control mode is executed, the controller 300 may turn on the vacuum pump 200 after the storage container is hermetically closed, such that the inside of the storage container is temporarily lowered below air pressure of 1 atm and thereafter maintained at about 1 atm. That is, the controller 300 may turn on the vacuum pump 200 to reduce the internal air pressure of the storage container 100 below 1 atm, and turn off the vacuum pump 200 to restore the internal air pressure of the storage container 100 to 1 atm and allow the internal air pressure at 1 atm to be maintained.

Here, under the control of the controller 300, the process of turning on the vacuum pump 200 plural times so as to reduce internal air pressure of the storage container and restoring the internal air pressure to the initial air pressure to be maintained in the state may be repetitively carried out. Also, the controller 300 may control the process to be repetitively carried out in a periodic manner.

The controller 300, as shown in FIG. 7, may control an internal air pressure control condition and an air pressure control mode of the storage container 100. The storage container 100 may be connected with the vacuum pump 200 such that the internal air pressure can be adjusted.

The vacuum pump 200 may be installed in the storage container 100 to suck internal air of the storage container 100 after the storage container 100 is hermetically closed, such that the inside of the storage container 100 can be in a state below air pressure of 1 atm.

The controller 300 may overall manage internal air pressure control condition and air pressure control mode of the storage container 100 and generally control the vacuum pump 200. Accordingly, the controller 300 may control the number of turning on and off the vacuum pump 200 according to the air pressure control mode selected by a user. The controller 300 may also overall set the internal air pressure control condition of the storage container 100 according to whether vegetables or fruits are stored in the storage container 100, and control the set value accordingly.

The air pressure control mode of the storage container 100 may be activated by the controller 300 when the storage container 100 of the refrigerator is closed and deactivated when it is open.

That is, the closing and opening of the storage container 100 may not simply decide the turning on and off of the vacuum pump 200 but decide the activation and deactivation of the air pressure control mode of the storage container 100 according to an embodiment of the present disclosure.

Referring to FIG. 3, 7 minutes may be set as a time for which the temporarily air pressure-reduced state in response to turning on the vacuum pump 200 is maintained, namely, a time taken for the internal air pressure of the storage container 100 to be restored to the initial air pressure after turning on the vacuum pump 200 one time. That is, FIG. 2 shows a graph exhibiting a very short restoring time to the initial internal air pressure of the storage container 100 (based on 1.00 atm in FIG. 2) in response to turning on the vacuum pump 200 plural times because a short graph is merely drawn based on based on 24 hours.

Therefore, after the vacuum pump 200 is turned on plural times as shown in FIG. 2, the internal air pressure of the storage container 100 may be restored to the initial air pressure after about 7 minutes following each turn-on operation as shown in FIG. 3. Also, a time for which the internal air pressure of the storage container is maintained to be lower than the initial air pressure may be controlled to be shorter than a time for which it is maintained at the initial air pressure.

In accordance with another exemplary embodiment, after hermetically closing the storage container 100, the controller 300 may adjust pressure by two-time operation of turning on the vacuum pump 200 based on 24 hours. Here, as shown with an alternated long and short dash line in the graph of FIG. 2, the controller 300 may adjust internal air pressure of the storage container 100 by turning on the vacuum pump two times, each time at an 8-hour period.

Also, when the controller 300 turns on the vacuum pump 200 at the 8-hour period, the first turn-on operation of the vacuum pump 200 may be executed after 8 hours after hermetically closing the storage container 100, and then the second turn-on operation of the vacuum pump 200 may be executed after 16 hours.

In the exemplary embodiment shown with the alternated long and short dash line 1, the internal air pressure of the storage container 100 may be temporarily reduced down to approximately 0.91 atm at the first turn-on operation of the vacuum pump 200 by the controller 300, and temporarily reduced down to approximately 0.92 atm at the second turn-on operation of the vacuum pump 200 by the controller 300.

In another exemplary embodiment, the controller 300 may adjust internal air pressure of the storage container 100 by turning on the vacuum pump four times based on 24 hours after hermetically closing the storage container 100. Here, as shown with the dotted line in the graph of FIG. 2, the internal air pressure of the storage container 100 may be adjusted by turning on the vacuum pump 200 four times, each time at a 6-hour period.

Also, in an exemplary embodiment indicated with a dotted line 3, after the storage container 100 is hermetically closed, the controller 300 may execute the first turn-on operation of the vacuum pump 200 after an hour and a half, the second turn-on operation of the vacuum pump 200 after 7 and a half hours, the third turn-on operation of the vacuum pump 200 after 13 and a half hours, and the fourth turn-on operation of the vacuum pump 200 after 19 and a half hours.

In the exemplary embodiment of the dotted line 3, the controller 300 may uniformly reduce the internal air pressure of the storage container 100 down to about 0.90 atm at each of the four-time turn-on operations of the vacuum pump 200, and restore the reduced internal air pressure up to about 1.00 atm as the initial air pressure.

As another exemplary embodiment, after hermetically closing the storage container 100, the controller 300 may adjust air pressure by turning on the vacuum pump 200 six times based on 24 hours. Here, as shown with a solid line 5 in the graph of FIG. 2, the internal air pressure of the storage container 100 may be adjusted by turning on the vacuum pump six times, each time at a 4-hour period.

In an exemplary embodiment indicated with the solid line 5, after hermetically closing the storage container 100, the controller 300 may execute the first turn-on operation of the vacuum pump 200 after an hour and a half, the second turn-on operation of the vacuum pump 200 after 5 and a half hours, the third turn-on operation of the vacuum pump 200 after 9 and a half hours, the fourth turn-on operation of the vacuum pump 200 after 13 and a half hours, the fifth turn-on operation of the vacuum pump 200 after 17 and a half hours, and the sixth turn-on operation of the vacuum pump 200 after 21 and a half hours.

Accordingly, as indicated with the solid line 5 of FIG. 2, the controller 300 may reduce the internal air pressure of the storage container 100 down to about 0.91 atm during the first to third turn-on operations of the vacuum pump 200 and thereafter restore the reduced internal air pressure up to about 1.00 atm as the initial air pressure. The controller 300 may reduce the internal air pressure of the storage container 100 down to 0.90 atm during the fourth to sixth turn-on operations of the vacuum pump 200 and thereafter restore the reduced internal air pressure up to about 1.00 atm as the initial air pressure.

FIG. 4 shows comparison results of dryness of stored stuffs in the related art storage container and dryness of stored stuffs such as vegetables and fruits in the storage container for the refrigerator according to the present disclosure to which the pressure control mode as shown in the aforementioned embodiments is applied.

As shown in FIG. 4, it can be noticed that the related art storage container for the refrigerator generally has 7.90% of dryness in a non-closed state and 4.57% of dryness in a hermetically closed state.

Thus, even in case of hermetically closing the storage container and uniformly maintaining internal air pressure of the storage container, the storage container according to the related art may be expected to have 4.57% of dryness.

In contrast, the storage container according to the present disclosure may exhibit 3.74% of dryness upon two-time temporary air pressure reduction, 3.87% of dryness upon four-time temporary air pressure reduction, and 3.72% of dryness upon six-time temporary air pressure reduction, based upon 24 hours.

Therefore, when the air pressure of the storage container is controlled by applying the exemplary embodiments of the present disclosure, dryness within the storage container may be reduced and accordingly, freshness of vegetables may be efficiently maintained. As shown in FIG. 4, it can be noticed that the freshness of vegetable and fruits stored has been improved, having an average 3.78% of dryness by the two-time, four-time and six-time temporary air pressure reductions.

FIGS. 5 and 6 show measurement results of dryness and freshness of vegetables stored in the related art storage container and the storage container according to the exemplary embodiments of the present disclosure, respectively, which show check results of stems and leaves of bok choy (FIG. 5) and spinach (FIG. 6) after each of the vegetables is stored in the storage container, for example, for 7 days when the stored vegetables are the bok choy and the spinach.

Referring to FIGS. 5 and 6, when the bok choy (FIG. 5) and the spinach (FIG. 6) are stored in the storage container for 7 days, they exhibit an increased dryness and a drastically reduced freshness in the related art storage container.

The bok choy of FIG. 5, stored in the related art storage container, exhibits extremely lost freshness and dried stems, and shows conspicuously wilted leaves. Also, the spinach of FIG. 6, stored in the related art storage container, exhibits rolled ends of leaves due to being dried and definitely lowered freshness due to weak stems being dried.

Even when the storage container is hermetically closed, the bok choy and the spinach exhibit the increased dryness and the drastically lowered freshness.

In contrast, when internal air pressure of the storage container is controlled according to the various exemplary embodiments of the present disclosure, it can be noticed that the vegetables remain fresh owing to the remarkably reduced dryness of stems and leaves, and freshness of the vegetables is remarkably improved owing to maintaining the fresh state of the vegetables as almost the same as the initial state when they were stored in the storage container.

FIGS. 5 and 6 show the dryness and the freshness when vegetables are stored. However, the present disclosure may not be limited to the case, and the refrigerator having the air pressure controllable storage container according to the present disclosure may be configured to control air pressure differently according to according to types of stored stuffs (vegetables, fruits, and etc.) in the storage container. That is, an air pressure control condition for appropriately maintaining freshness of stuff stored may be decided according to variables, such as the number of reducing internal air pressure of the storage container in response to the controller turning on the vacuum pump, an air pressure-reduced level (a target air pressure to be reduced), a time interval from an one-time air pressure reduction to the next air pressure reduction, a reduced air pressure maintaining time (a time for which air pressure is maintained to be lower than initial air pressure), and the like. The internal air pressure of the storage container may be controlled according to the decided air pressure control condition. The air pressure control condition may be selected by the user through the input unit 400, or prestored in a memory 600 to be retrieved by the controller 300. The memory 600 may be volatile or non-volatile memory well known to those skilled in the art and its hardware will not be discussed.

For example, when the stored stuff in the storage container is fruit, a target air pressure to be reduced may be in the range of 0.95 to 1.00 atm. However, when the stored stuff is vegetable, a target air pressure to be reduced may be in the range of 0.8 to 0.9 atm. Fruits may be stored fresher when the inside of the storage container is maintained under air pressure close to 1.0 atm which is an average atmospheric pressure of the outside of the storage container. Vegetables may be stored fresher at air pressure close to 0.8 atm.

Here, a target air pressure to be reduced with respect to the storage container may be set by a user. When the user sets a stuff to store, the internal air pressure of the storage container may be controlled according to a predetermined air pressure control condition.

For reference, FIGS. 2 and 3 show that the internal air pressure of the storage container is initially 1.00 atm. The initial air pressure may be different according to sea level of places where embodiments of the present invention is installed.

As another exemplary embodiment, referring to FIG. 7, the refrigerator having the air pressure controllable storage container may further include a display unit 500 to allow the controller 300 to display an internal air pressure state of the storage container 100 and an air pressure control mode.

The refrigerator may further include an input unit 400 to receive a user selection when the user selects the air pressure control mode and/or the air pressure control condition of the storage container 100 with reference to the outputs on the display unit 500. The input unit 400 may receive various air pressure control conditions input by the user. For example, the user may set a target internal air pressure to be reduced with respect to the storage container, the number of reducing air pressure, a reduced air pressure maintaining time, an air pressure reduction period and the like. The input unit 400 may then receive the user settings. Or, the user may set a type of stuff to store, namely, whether a stuff to be stored is fruit or vegetable, and the input unit 400 may receive the user setting. The input unit 400 and the display unit 500 are well known hardware to those skilled in the art and will not be further discussed.

The display unit 500, as shown in FIG. 7, may display the state of the storage container and the air pressure control mode and condition such that the user can view those information. Here, the display unit 500 may be installed on a front surface of the storage container 100 or the refrigerator such that the user can see it easily.

The air pressure state and the air pressure control mode of the storage container 100 may be displayed on the display unit 500 to allow the user to easily check the internal state of the storage container 100.

The input unit 400, as shown in FIG. 7, is a component for allowing a user to execute an air pressure control function of the storage container. Therefore, the input unit 400 may preferably be installed at a position outside the storage container 100 or the front surface of the refrigerator such that the user can easily input settings.

The input unit 400 may transfer an input signal for the air pressure control mode and the air pressure condition set by the user to the controller 300. The controller 300 may turn on the vacuum pump 200 in response to the input signal transferred thereto, and simultaneously overall control internal conditions of the storage container 100 by checking the state of the storage container 100.

Hereinafter, description will be given of a control method for the refrigerator having the air pressure controllable storage container according to the present disclosure with reference to FIGS. 8 and 9. FIG. 8 is a flowchart showing a control method in accordance with one exemplary embodiment of the present disclosure, and FIG. 9 is a flowchart showing a control method in accordance with another exemplary embodiment of the present disclosure.

In accordance with one exemplary embodiment of the present disclosure, a control method, as shown in FIG. 8, may include a controller receiving a selection of an air pressure control mode of a storage container (S110), and turning on a vacuum pump such that internal air pressure of the storage container is lower than initial air pressure (S130) and turning off the vacuum pump such that the internal air pressure of the storage container is restored to the initial air pressure when the air pressure control mode is selected (S160).

Here, the step S110 of the controller receiving the air pressure control mode selection may receive a selection signal when the user stores stuffs (vegetables or fruits) in the storage container 100 and closes, preferably hermetically, the storage container 100 with a cover, or receive a selection signal when the user selects the air pressure control mode, for example, using an input unit.

The step S130 of the controller turning on the vacuum pump and turning off the vacuum pump may be activated as the user stores the stuffs (vegetables or fruits) in the storage container 100 and hermetically closes the storage container 100 with a cover or makes the selection at the input unit.

In accordance with another exemplary embodiment, the method may further include the controller receiving a setting for an internal air pressure control condition of the storage container (S120). Here, the air pressure control mode is activated in response to closing, preferably hermetically, the storage container 100. The storage container 100 may operate under the user-set air pressure control condition. The air pressure control condition may include at least one of a target air pressure to be reduced, the number of reducing air pressure, a reduced air pressure maintaining time and an air pressure reduction period.

When the air pressure control mode is activated, the vacuum pump (vacuum motor) may be repetitively turned on and off at a predetermined air pressure reduction period and/or by the number of reducing air pressure by the controller. Accordingly, internal air pressure of the storage container changes. When a preset reduced air pressure maintaining time arrives (S140) in response to the turn-on operation of the vacuum pump (S130), the controller may determine whether or not the internal air pressure of the storage container has reached a preset target air pressure to be reduced (S150). When the internal air pressure of the storage container has reached the preset target air pressure to be reduced, the vacuum pump may be turned off by the controller (S160). Afterwards, the vacuum pump may be turned on again according to a preset air pressure reduction period and/or the number of reducing air pressure.

By turning on the vacuum pump according to a preset time and a preset number of times, the number of turning on the vacuum pump may be appropriately adjusted. This may extend a lifespan of the vacuum pump, and reduce power consumption.

In accordance with another exemplary embodiment as shown in FIG. 9, the method may further include receiving a selection of a stuff to be stored in the storage container. For example, the present disclosure may provide a control method for a refrigerator having an air pressure controllable storage container, which may include the controller receiving a selection of an air pressure control mode of the storage container (S210). The controller may optionally receive a selection of a stuff to be stored in the storage container (S220). If step S220 is performed, the controller may automatically perform steps S230 and S240 based on prestored settings in the memory. Otherwise, the controller may receive setting on a reduced air pressure maintaining time and an air pressure control condition based on the stuff to be stored, setting on an air pressure reduction period (S230), and setting on the number of reducing air pressure according to the air pressure reduction period (S240). The controller may turn on and off the vacuum pump according to the set air pressure control condition (S250).

The receiving of the air pressure control mode selection (S210) may be executed to automatically activate the air pressure control mode in response to closing, preferably, hermetically, the storage container 100 or activating the air pressure control mode in response to an input of a selection signal when the user selects the air pressure control mode at the input unit.

The receiving of the selection of the stuff to be stored (S220) may be executed in the input unit to allow the user to select whether vegetable or fruit is to be stored in the storage container because the stuff to be stored may decide the internal air pressure control condition of the storage container.

The setting of the reduced air pressure maintaining time and the air pressure control condition may be executed to allow the controller to set the reduced air pressure maintaining time and the air pressure control condition based on the stuff to be stored, selected by the user or prestored in the memory of the refrigerator. For example, when the stuff to be stored is fruit, the controller may set an air pressure in the air pressure reduced state to be maintained in the range of 0.95 to 1.0 atm. When the stuff to be stored is vegetable, the controller may set the air pressure in the air pressure reduced state to be maintained in the range of 0.8 to 0.9 atm. That is, when the stored stuff in the storage container is fruit, a target air pressure to be reduced may be in the range of 0.95 to 1.00 atm. And, when the stored stuff is vegetable, a target air pressure to be reduced may be in the range of 0.8 to 0.9 atm.

The setting of the air pressure reduction period (S240) may be executed to set the number of turning on the vacuum pump basically based on 24 hours. Therefore, the number of turning on the vacuum pump may increase when a short air pressure reduction period is set, while decreasing when a long air pressure reduction period is set. Consequently, the vacuum pump may be relevantly turned on and off in the periodic manner without being continuously turned on, which may extend the lifespan of the vacuum pump. This may thus result in reduction of power consumption and enhance economical efficiency.

Next, the vacuum pump (vacuum motor) may be turned on and off according to the preset air pressure reduction period and the preset number of reducing air pressure (S250).

As described above, transpiration of stuffs stored such as vegetables, fruits and the like may be prevented by setting an air pressure control mode, so as to improve freshness of the stuffs stored. An appropriate air pressure state may be maintained according to the stuffs stored, based on a reduced air pressure maintaining time and an air pressure control condition. Simultaneously, freshness of the stuffs stored may be continuously controlled by a periodic air pressure control in response to a vacuum pump being turned on plural times.

In addition, the air pressure control condition may be set by user selection or prestored in a memory and the settings may be displayed on a display unit, which may allow the user to directly control freshness and feel more convenient.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator having an air pressure controllable storage container, the refrigerator comprising:

a storage container;

a vacuum pump to suck internal air of the storage container;

a controller to operate in an air pressure control mode by turning on the vacuum pump such that an internal air pressure of the storage container is at an air pressure-reduced state that is lower than an initial air pressure of the storage container and turning off the vacuum pump at a target air pressure so as to allow the internal air pressure of the storage container to be restored to the initial air pressure, wherein the controller turns the vacuum pump on and off based on a predetermined air pressure control condition of the storage container, wherein the air pressure control condition comprises at least one of the target air pressure to be reduced in response to the turn-on operation of the vacuum pump, a number of times of reducing air pressure, a time of a first turn-on operation of the vacuum pump after the storage container being hermetically closed, a reduced air pressure maintaining time, and an air pressure reduction period, wherein the controller controls the vacuum pump to change at least one of the target air pressure to be reduced in response to the turn-on operation of the vacuum pump and the time of first turn-on operation of the vacuum pump after the storage container being hermetically closed according to the air pressure reduction period.

2. The refrigerator of claim 1, wherein the controller controls the vacuum pump to turn on and to turn off a number of times during a time period.

3. The refrigerator of claim 2, wherein the controller controls the vacuum pump turning on and off sequence such that at least one target air pressure to be reduced from the initial air pressure of the storage container in one sequence is different from the target air pressure of another sequence.

4. The refrigerator of claim 1, wherein the air pressure-reduced state is any air pressure lower than the initial air pressure, and the controller controls the vacuum pump such that the air pressure-reduced state is maintained for a predetermined time period prior to the internal air pressure of the storage container being restored to the initial air pressure.

5. The refrigerator of claim 1, wherein the controller is activated to operate in the air pressure control mode when the storage container is closed, and is deactivated from operating in the air pressure control mode when the storage container is open.

6. The refrigerator of claim 1, wherein the controller is activated or deactivated to operate in the air pressure control mode based on an input signal from the input unit.

7. The refrigerator of claim 1, further comprising a memory to store an air pressure control condition, wherein the controller retrieves the air pressure control condition from the memory, and turns the vacuum pump on and off based on the pressure control condition, wherein the air pressure control condition comprises at least one of the target air pressure to be reduced in response to the first turn-on operation of the vacuum pump, the number of times of reducing air pressure, the reduced air pressure maintaining time, and the air pressure reduction period.

8. The refrigerator of claim 1, wherein the controller controls the vacuum pump such that the target air pressure to which the internal air pressure of the storage container is reduced based on the stuff stored in the storage container.

9. A control method for a refrigerator having an air pressure controllable storage container, the method comprising:

receiving a signal by a controller to operate in an air pressure control mode for a refrigerator storage container;

turning on a vacuum pump by the controller such that an internal air pressure of the storage container is at an air pressure-reduced state that is lower than an initial air pressure of the storage container and turning off the vacuum pump at a target air pressure so as to allow the internal air pressure of the storage container to be restored to the initial air pressure; and controlling by the controller to operate the vacuum pump based on a predetermined air pressure control condition, wherein the air pressure control condition comprises at least one of a target air pressure to be reduced in response to the turn-on operation of the vacuum pump, the number of times of reducing air pressure, a time of a first turn-on operation of the vacuum pump after the storage container being hermetically closed, a reduced air pressure maintaining time, and an air pressure reduction period, wherein the vacuum pump is controlled by the controller to change at least one of the target air pressure to be reduced in response to the turn-on operation of the vacuum pump and the time of first turn-on operation of the vacuum pump after the storage container being hermetically closed according to the air pressure reduction period.

10. The method of claim 9, wherein the controller controls the vacuum pump to turn on and off a number of times during a time period.

11. The method of claim 10, further comprises controlling by the controller the vacuum pump turning on and off sequence such that at least one target air pressure to be reduced from the initial air pressure of the storage container in one sequence is different from the target air pressure of another sequence.

12. The method of claim 9, wherein the air pressure-reduced state is any air pressure lower than the initial air pressure, the method further comprises controlling by the controller the vacuum pump such that the air pressure-reduced state is maintained for a predetermined time period prior to the internal air pressure of the storage container being restored to the initial air pressure.

13. The method of claim 9, further comprises activating the controller to operate in the air pressure control mode when the storage container is closed, and deactivating the controller from operating in the air pressure control mode when the storage container is open.

14. The method of claim 9, further comprises activating or deactivating the controller to operate in the air pressure control mode.

15. The method of claim 9, further comprises:

receiving by the controller a setting for an air pressure control condition from a memory; and controlling by the controller to operate the vacuum pump based on the air pressure control condition, wherein the air pressure control condition comprises at least one of a target air pressure to be reduced in response to the first turn-on operation of the vacuum pump, the number of reducing air pressure, the reduced air pressure maintaining time, and the air pressure reduction period.

16. The method of claim 9, further comprises controlling by the controller the vacuum pump such that the target air pressure to which the internal air pressure of the storage container is reduced is based on the stuff stored in the storage container.

* * * * *